United States Patent [19]

Taplin

[11] 4,169,490

[45] Oct. 2, 1979

[54] PILOT OPERATED FOUR WAY VALVE

[76] Inventor: John F. Taplin, 15 Sewall St., West Newton, Mass. 02165

[21] Appl. No.: 803,001

[22] Filed: Jun. 3, 1977

[51] Int. Cl.[2] ..... F15B 13/042

[52] U.S. Cl. ..... 137/596.18; 91/4 R; 137/596.15

[58] Field of Search ..... 251/61, 61.1; 137/596.14, 596.15, 596.16, 596.18, 596.2; 91/454, 457

[56] References Cited

U.S. PATENT DOCUMENTS

| | | | |
|---|---|---|---|
| 3,016,918 | 1/1962 | Wentworth | 137/596.15 |
| 3,080,887 | 3/1963 | Brandenberg | 91/454 |

FOREIGN PATENT DOCUMENTS

| | | | |
|---|---|---|---|
| 2527330 | 1/1977 | Fed. Rep. of Germany | 91/454 |

*Primary Examiner*—Martin P. Schwadron

*Assistant Examiner*—A. Michael Chambers

*Attorney, Agent, or Firm*—Erwin Salzer

[57] ABSTRACT

A pilot valve for reversing the flow of fluid in a pair of pipes. The valve is less complex than prior art devices serving the same purpose, comprising in essence four aligned rolling diaphragm devices which are automatically controlled by the presence, or absence, respectively of pilot pressure. If pilot pressure is present, a flow of fluid under pressure is established in one of two pipes and the other is vented. On the other hand, if pilot pressure is removed, the pipe in which a flow of fluid under pressure had been established is vented and a flow of fluid under pressure is established in the pipe which has been previously vented. The output of the pipe in which a flow of pressure is established may be used to operate and to reverse the operation of a cylinder and piston machine, such as, for instance, a pneumatic or fluid motor.

3 Claims, 2 Drawing Figures

PILOT OPERATED FOUR WAY VALVE

BACKGROUND OF THE INVENTION

As stated above, the invention solves an old problem with novel and simpler means.

SUMMARY OF THE INVENTION

A pilot valve embodying this invention includes a first pair of rolling diaphragm devices each having a convex rolling wall and a second pair of rolling diaphragm devices each having a concave rolling wall. The pilot valve includes a chamber common to said first and second pair of rolling diaphragm devices for admitting substantially simultaneously fluid under pressure to said convex and to said concave rolling walls thereof. A conduit is provided to supply a fluid under pressure substantially simultaneously to the reverse sides of the rolling diaphragms of said first and said second pair of rolling diaphragm devices. A pair of non-communicating chambers is adapted to be connected selectively to said conduit. The rolling diaphragms of said first pair of rolling diaphragm devices controls a pair of oppositely operating valves of which one opens and the other closes substantially simultaneously in response to admission of fluid under pressure to said chamber and of which either causes venting of one of said non-communicating chambers to atmosphere. The rolling diaphragms of said second pair of rolling diaphragm devices control a second pair of oppositely operating valves each connecting said conduit selectively to one of said pair of non-communicating chambers when open and disconnecting said conduit selectively from one of said pair of non-communicating chambers when closed.

DESCRIPTION OF PREFERRED EMBODIMENT

Figure 2:
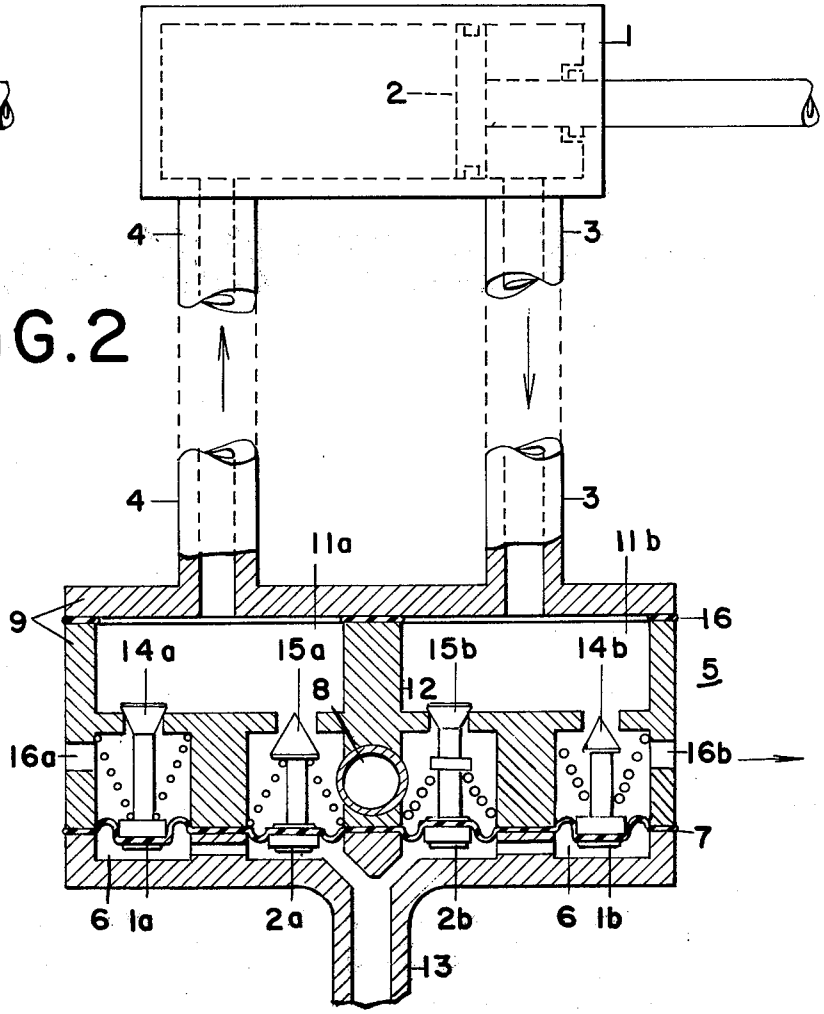
FIG. 2 shows diagrammatically the same device as FIG. 1 in the other of its two limit positions.
Figure 1:
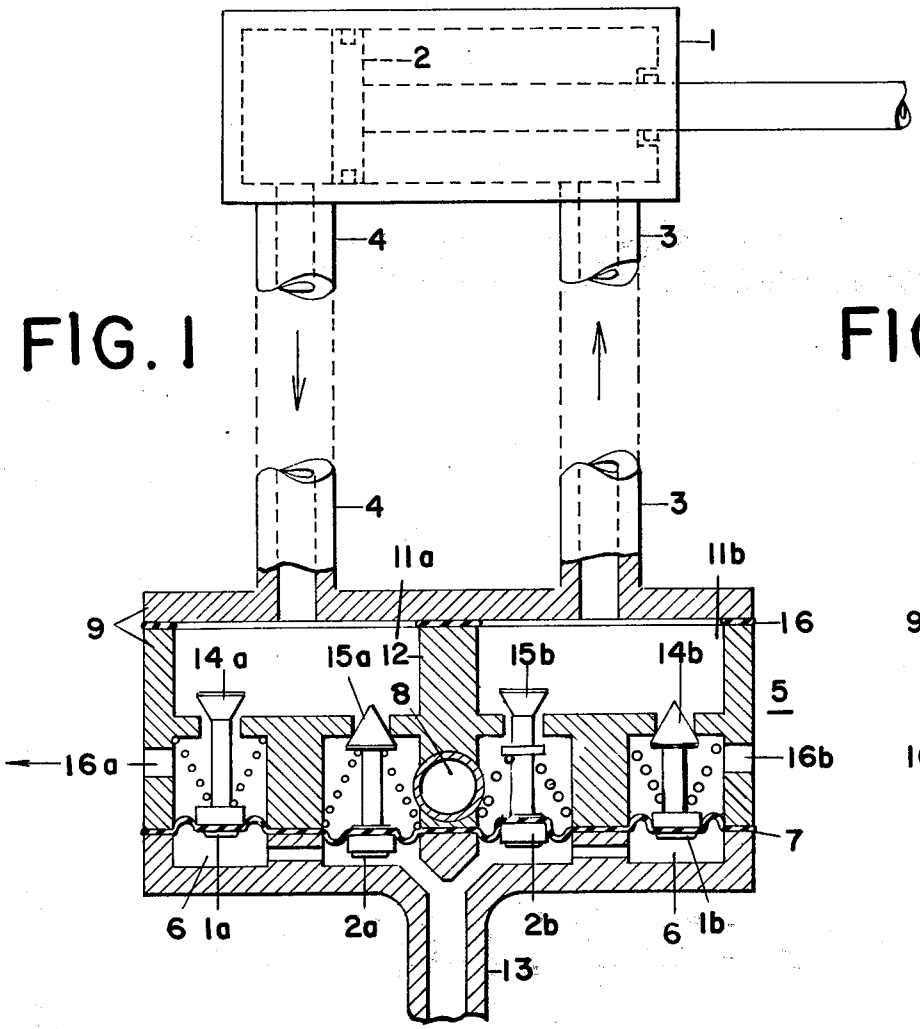
FIG. 1 shows diagrammatically a device embodying this invention in one of its two limit positions.

Referring now to the drawings, FIG. 1 and FIG. 2 show a fluid motor comprising the cylinder 1 and the piston 2. According to FIG. 1 fluid under pressure is admitted to cylinder 1 by pipe 3 and cylinder 1 is vented through pipe 4. According to FIG. 2 fluid under pressure is admitted through pipe 4 to cylinder 1 and the latter is vented through pipe 3. This reversal of the direction of motion of fluid motor 1,2 is achieved by the pilot valves shown in the lower portion of the drawing and generally indicated by numeral 5.

The pilot valve 5 includes a first pair of rolling diaphragm devices 1*a*,1*b* each having a convex rolling wall as clearly shown in the drawing. A second pair of rolling diaphragm devices 2*a*,2*b* each has a concave rolling wall as likewise clearly shown in the drawing. A chamber 6 is common to devices 1*a*,1*b*, 2*a*,2*b* for admitting substantially simultaneously fluid under pressure to said convex and concave rolling walls of devices 1*a*,1*b*-,2*a*,2*b*. Chamber 6 is connected to a manifold 13 which, in turn, is connected to a source of fluid under pressure (not shown). Reference numeral 8 has been applied to indicate a conduit entering housing 9 from the rear side thereof and adapted to supply fluid under pressure to the reverse sides of the rolling diaphragm 7 of rolling diaphragm devices 1*a*,1*b*,2*a*,2*b*. Housing 9 forms a pair of non-communicating chambers 11*a*,11*b* separated by partition 12. Both chambers 11*a*,11*b* are adapted by means of valve-controlled channels to be connected selectively to conduit 8. Each rolling diaphragm device 1*a*,1*b*,2*a*,2*b* controls by means of a valve stem a tap (i.e. poppet) valve designated respectively by the numerals 14*a*,14*b*,15*a*,15*b* which are spring biased as indicated in the drawing. The ends of housing 9 are provided with venting passages 16*a*,16*b*.

Upon admission of fluid under pressure to manifold 13 and to conduit 8 all the valves or taps 14*a*,14*b*,-15*a*,15*b* are lifted. This causes opening of valves or taps 14*a*,15*b* and closing of valves or taps 15*a*,14*b*. Consequently fluid under pressure derived from duct 8 is prevented by valve 15*a* from flowing into chamber 11*a*, but is allowed by open valve 15*b* to flow into chamber 11*b* and from there through pipe 3 to motor 1,2. Open valve 14*a* allows dumping of air from motor 1,2 through pipe 4, chamber 11*a*, valve 14*a* and venting passage 16*a*. Air in the space above the diaphragm of valve unit 1*b*,14*b* is allowed to vent through vent opening or venting port 16*b*. This situation has been illustrated in FIG. 1.

Assuming that the admission of air under pressure to manifold 13 is turned off, while the supply of air to conduit 8 remains uninterrupted. This causes closing of valves 14*a*,15*b* and opening of valves 15*a*,14*b*. This situation has been illustrated in FIG. 2. Since valve 15*a* is open and valve or tap 14*a* closed, a flow of fluid is established from pipe 8 through valve 15*a*, chamber 11*a* and pipe 4 to fluid motor 1,2. Since valve 15*b* is closed and valve 14*b* is open, no fluid under pressure can enter chamber 11*b* and the latter is vented through open valve 14*b* and venting port 16*b*. Venting port 16*a* allows venting of the space above rolling diaphragm device 1*a*.

Housing 9 consists of an upper or cover part and a lower or hood part separated by gasket 16.

Rolling diaphragm devices 1*a*,1*b*,2*a*,2*b* are connected with taps 14*a*,14*b*,15*a*,15*b* by means of stems and thus devices 1*a*,14*a*; 1*b*,14*b*; 2*a*,15*a*, 2*b*,15*b* form unitary structures. The valves 15*a*,15*b* controlling the input to fluid motor 1,2 are arranged in the center of housing 9 and the valves controlling venting of housing 9 are arranged at the ends of housing 9. The movable center portions of all rolling diaphragms 7 are arranged substantially in a common plane and deviate therefrom only a distance equal to the stroke of one of valves 14*a*,14*b*,15*a*,15*b*. All diaphragm devices 1*a*, 1*b*, 2*a*,2*b* and all valves 14*a*,14*b*,15*a*,15*b* are arranged in line, as the four cylinders of an internal combustion engine.

I claim as my invention:

1. A pilot valve for reversing the flow of fluid in a pair of pipes comprising in combination (a) a first pair of rolling diaphragm devices each operating one of a first pair of spring-biased valves (15*a*,15*b*), said first pair of rolling diaphragm devices being operable by fluid pressure against the action of the spring-bias on said first pair of valves (15*a*,15*b*), one (15*a*) of said first pair of valves being open and the other (15*b*) of said first pair of valves being closed in the absence of fluid pressure upon said first pair of rolling diaphragm devices;

(b) a second pair of rolling diaphragm devices each operating one of a second pair of spring-biased valves (14*a*,14*b*), said second pair of rolling diaphragm devices being operable by fluid pressure against the action of said spring-bias on said second pair of valves (14*a*,14*b*), one (14*a*) of said second pair of valves being open and the other (14*b*) of said second pair of valves being closed in the absence of fluid pressure upon said second pair of rolling diaphragm devices;

(c) a fluid duct (13) for selectively admitting or withholding fluid pressure from said first pair of rolling diaphragm devices and said second pair of rolling diaphragm devices;

(d) a pair of non-communicating chambers (11*a*,11*b*) including a first chamber (11*a*) and a second chamber (11*b*) each of said pair of chambers being connected to one of said pair of pipes;

(e) a first admission passageway for admitting fluid under pressure to said first chamber (11*a*) from a third pipe (8) with fluid under pressure and a first venting passageway for simultaneously venting said second chamber (11*b*), said first admission passageway being controlled by said one (15*a*) of said first pair of valves (15*a*,15*b*) and said first venting passageway being controlled by said other (14*b*) of said second pair of valves (14*a*,14*b*); and (f) a second admission passageway for admitting fluid under pressure to said second chamber (11*b*) from said third pipe (8) with fluid under pressure and a second venting passageway for simultaneously venting said first chamber (11*a*), said second admission passageway being controlled by said other (15*b*) of said first pair of valves (15*a*,15*b*) and said second venting passageway being controlled by said one (14*a*) of said second pair of valves (14*a*,14*b*).

2. A pilot valve as specified in claim 1 including a housing having three levels including a first level at which the means for admitting fluid pressure to said first pair of rolling diaphragms and said second pair of rolling diaphragms are located, a second level wherein the stems of said pair of valves operated by said first pair of rolling diaphragms and the stems of said pair of valves operated by said second pair of rolling diaphragms are located, and a third level situated above said first level and said second level occupied by said pair of non-communicating chambers.

3. A pilot valve as specified in claim 1 wherein each said first pair of rolling diaphragms and each of said second pair of rolling diaphragms include fixed clamping flanges and movable clamping flanges, wherein said movable clamping flanges of said first pair of rolling diaphragms and said movable clamping flanges of said second pair of rolling diaphragms are arranged substantially in the same plane, and wherein said first pair of rolling diaphragms and said second pair of rolling diaphragms are arranged in line.

* * * * *